United States Patent [19]

Richmond

[11] 4,103,380

[45] Aug. 1, 1978

[54] CLAMPING DEVICES

[76] Inventor: Raymond Richmond, c/o Thornton, Baker & Co., Eldon Lodge, Eldon Place, Bradford, England

[21] Appl. No.: 735,915

[22] Filed: Oct. 27, 1976

[30] Foreign Application Priority Data

Oct. 29, 1975 [GB] United Kingdom ..... 44521/75

[51] Int. Cl.[2] ..... B63B 23/00; A44B 11/10

[52] U.S. Cl. ..... 9/30; 24/68 CD; 24/196

[58] Field of Search ..... 24/171, 194, 195, 196, 24/265 CD, 68 CD, 68 SB, 68 E, 68 AS, 71.3, 71 SB, 71 TD, 71 ST, 73 PH; 248/499; 9/30, 31, 34, 35

[56] References Cited

U.S. PATENT DOCUMENTS

| | | | |
|---|---|---|---|
| 3,387,811 | 6/1968 | Adams, Jr. | 9/30 |
| 3,401,806 | 9/1968 | Schmit | 9/31 |
| 3,795,947 | 3/1974 | Thompson | 24/196 |

FOREIGN PATENT DOCUMENTS

| | | | |
|---|---|---|---|
| 754,937 | 8/1956 | United Kingdom | 24/196 |
| 1,300,114 | 12/1972 | United Kingdom | 24/68 CD |

*Primary Examiner*—Kenneth J. Dorner
*Attorney, Agent, or Firm*—William Anthony Drucker

[57] ABSTRACT

This invention relates to clamping devices and more particularly to a quick release clamping device capable of holding adjustable length means in adjusted effective length between an anchor element and the clamping device.

9 Claims, 5 Drawing Figures

Figure 1:
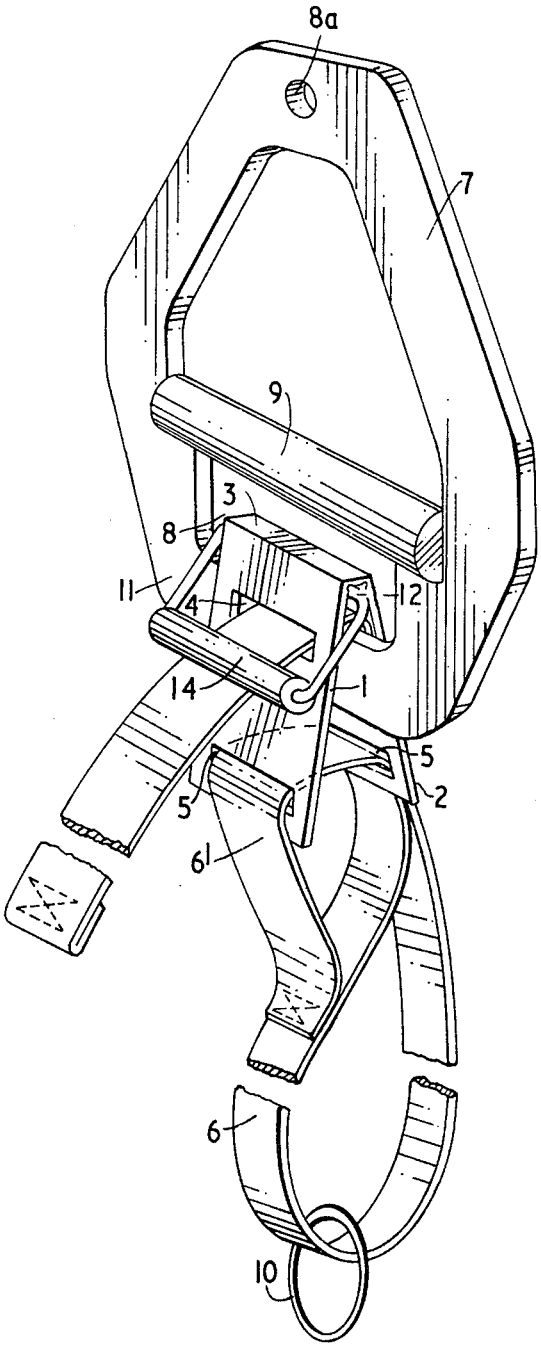

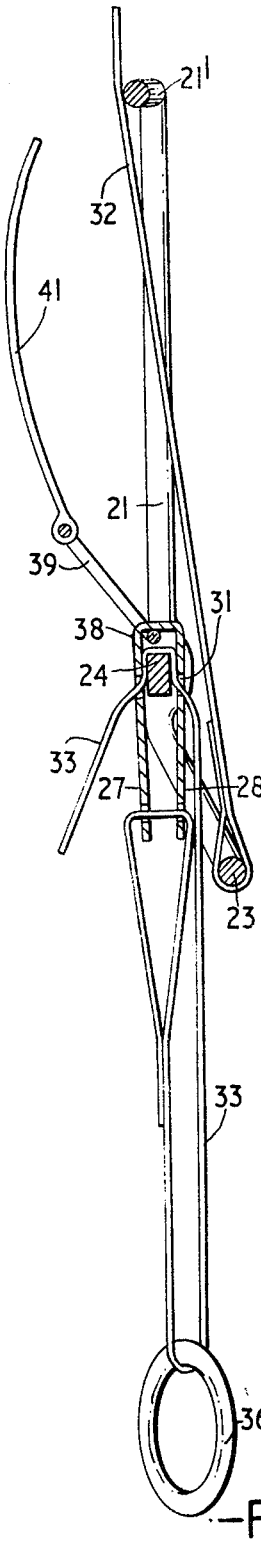
-FIG.4-
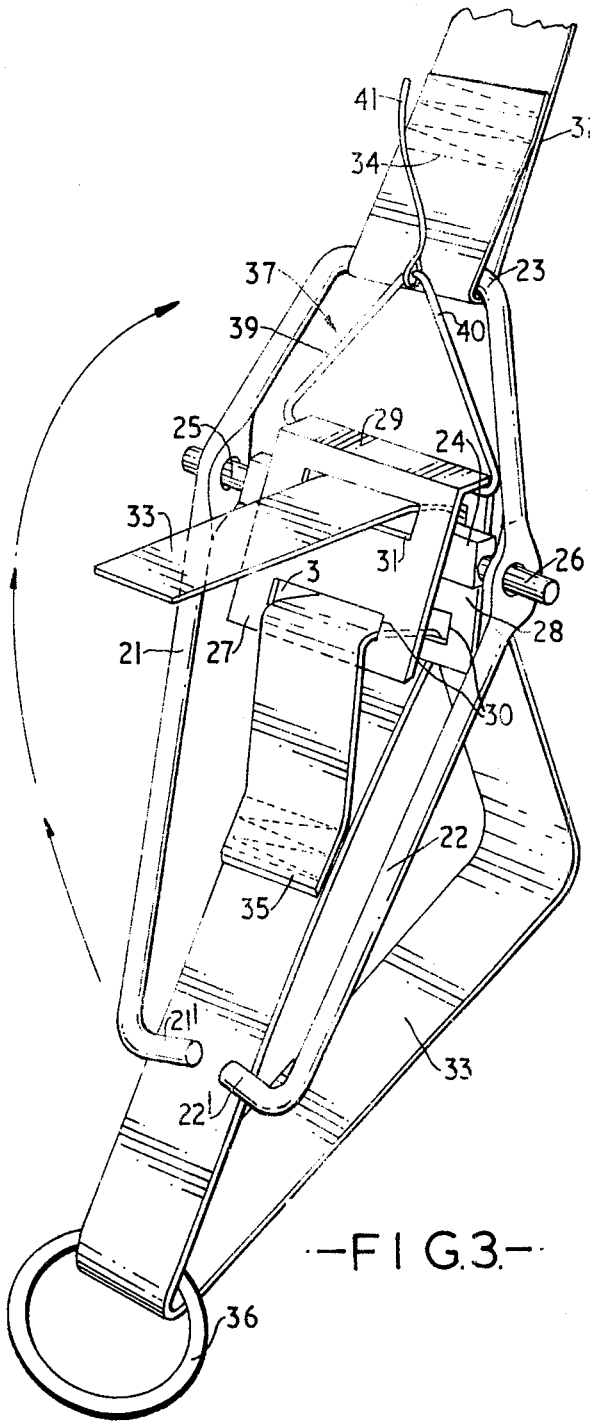
-FIG.3-

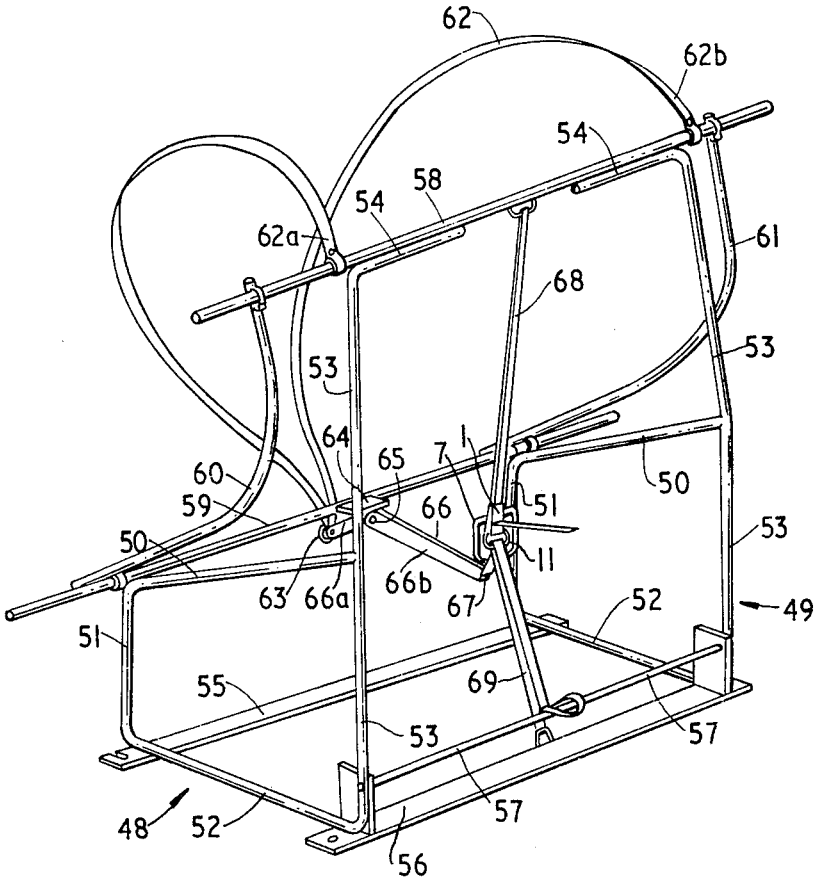
-FIG.5.-

CLAMPING DEVICES

In U.S. Pat. No. 3,795,947 there is described a clamping device comprising a clamping element of substantially U-shape with spaced apart apertures in each of its limbs and an apertured co-operating element such that, in use, with the clamping element extending through with its limbs on opposite sides of the co-operating element and a loop formed at the end of a length of flexible material extending through the apertures nearer the free ends of the clamping element limbs, the flexible material after passing through an attachment element and through the other apertures in the limbs of the clamping element between the base of that element and an edge of the aperture in the co-operating element will be held due to strain on such material pulling the clamping element towards the co-operating element; the effective length of the flexible material being determined by passing a greater or lesser length thereof through the clamping element while it is relieved of strain.

A problem with such a device is that, when the device is clamping a flexible member under high strain conditions, it becomes difficult to release the clamping member and, particularly for safety equipment, the clamping device must release simply and positively.

The present invention seeks to provide a clamping device capable of releasing simply and positively.

According to the present invention there is provided a clamping device comprising a U-shaped member and a co-operating element between the limbs of said U-shaped member, co-operating apertures in said U-shaped member and through which a flexible adjustable length member can pass so as to lie between the co-operating element and the closed end of said U-shaped member, said apertures being spaced from the closed end of said U-shaped member whereby, when the U-shaped member is displaced in one direction to define a clamping condition for the device the distance between the co-operating element and the closed end of the U-shaped member is reduced and the co-operating element engages the flexible adjustable length member within the U-shaped member and forms a bight therein to clamp said flexible adjustable length member and when the U-shaped member is displaced in the opposite direction from the clamping condition the closed end of the U-shaped member is moved away from the co-operating element to progressively reduce the depth of the bight in said flexible adjustable length member and subsequently loses engagement with the flexible adjustable length member, thus releasing said member, and characterized in that the device includes a quick release element associated with the U-shaped member and by the actuation of which the U-shaped member is positively displaced from the clamping condition to a released condition.

In one embodiment in accordance with the invention the quick release element may comprise a hand grip or handle formed integral with or secured to the U-shaped member.

In a preferred embodiment the quick release element comprises a closed loop member which passes through the U-shaped member between the closed end of the U-shaped member and the path of flexible adjustable length material passing through the apertures in said U-shaped member. The closed loop member may conveniently have a hand grip, handle or lanyard attached thereto for easy manual actuation of the quick release element.

The invention also envisages a support arrangement for a safety floatation device or boat, hereinafter referred to as the floatation device, and comprising a frame for supporting the floatation device, a restraining sling for restraining the floatation device on the frame and a pivotal lever attached to said frame and having one free end detachably engageable with said restraining sling and its other end supportable by a said clamping device.

Preferably said frame is made from tubular material and comprises support members upon which the floatation device is supported, and a side frame against which the floatation device is restrained by the restraining sling. The frame may conveniently include an underpart supporting the support members above the surface upon which the frame is mounted.

In a preferred embodiment the frame is made from a tubular material and the support members conveniently slope downwardly away from the said side frame at such an angle that the floatation device will slide freely therefrom when unrestrained by the restraining sling.

Preferably the frame is pivotally attached to the surface upon which said frame stands and whereby the frame, and any floatation device supported thereon, can be rotated through some 90° about a horizontal axis to facilitate mounting and servicing of the floatation device.

Preferably the restraining sling has its ends fixedly secured to spaced apart locations on the upper regions of the said side part and the mid-region of the sling is engageable with the pivotal lever, conveniently through an attaching member. Alternatively, the restraining sling may comprise two equal lengths of material connected at adjacent ends by an attaching member. Such an attaching member may comprise a metal ring engageable by the sling-engaging end of the lever.

Preferably the lever is a bell crank lever, that end engageable with the restraining sling has a hook shaped end to facilitate engagement with and retention of the sling, and the other free end extending towards the plane of the side frame. Preferably the length of the lever arm between the pivotal connection and the quick release element is between 3.5 and 5.5 times greater than the length of the lever arm between the pivotal connection and the restraint sling engagement.

Preferably the quick release element is attached to the upper regions of the side frame by an elongate member, conveniently a flexible adjustable length member, and the adjacent end of the lever is attached to the co-operating element of the device.

Preferably the clamping device includes a quick release element as hereinbefore defined and said element is attached to a flexible elongate member connected to the ground regions of the frame.

Figure 2:
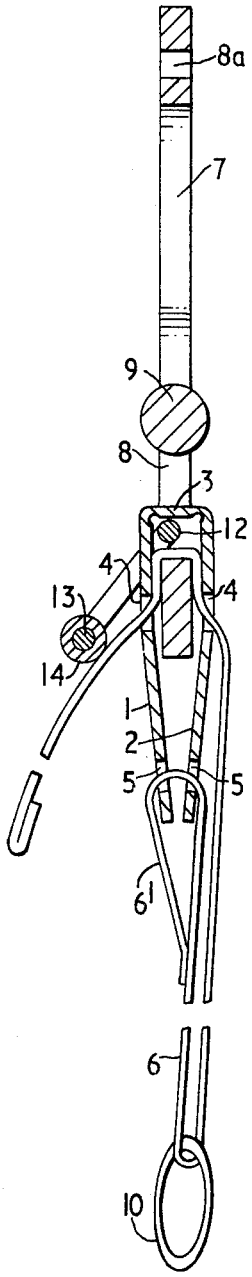

The invention will now be described further by way of example with reference to the accompanying drawings in which:

FIG. 1 shows a perspective view of one clamping arrangement with a quick release element in accordance with the invention, FIG. 2 shows a longitudinal section through the clamping arrangement of FIG. 1 showing the parts of the clamp when under strain, FIG. 3 shows a perspective view of a second embodiment of a clamping device provided with a quick release element, FIG. 4 shows a longitudinal section through the device of FIG. 3, and FIG. 5 shows, diagrammatically, a perspective view of a support arrangement for a floatation device.

The clamping member in the form illustrated in FIGS. 1 and 2 is made of a plastics material, such as polypropylene, and comprises limbs 1 and 2 integral with a base portion 3. Each limb 1, 2 is formed with two spaced apart parallel transverse apertures 4, 5.

A flexible adjustable length member comprises an elongated flat woven web 6 of flexible material, such as nylon.

A co-operating element may take a variety of forms, but in this example comprises a moulding 7 preferably of a plastics material, with an aperture 8 in which the clamping member is located with its base portion 3 within aperture 8 and limbs 1, 2 extending on opposite sides of the end portion of the co-operating element 7 bounding aperture 8. The moulding 7 has an aperture 8*a* to receive an end of a strain wire or like member. A hand grip 9 is provided to extend across an enlargement of the aperture 8.

After positioning the clamping member with respect to the co-operating element 7, one end of the web 6 is passed through the apertures 5 in the limbs 1 and 2 and then secured to the web 6 so forming an end loop 6'. The other end of the web 6 is passed through an attachment element, which in the FIG. 1 and 2 example comprises a simple ring 10, and then successively through the apertures 4 in the limbs 1, 2 of the clamping element so that between links 1 and 2 the web 6 lies between the co-operating element 7 and the base portion 3.

When the adjustable length web 6 is free of strain, as illustrated in FIG. 1, the clamping member may move inwardly towards the mid-regions of the co-operating element 7 and the web 6 may slide freely through the apertures 4 while aligned with the aperture 8, either to increase or reduce the effective length of web 6 between the attachment 10 and the clamping device.

When now the web is tensioned the end loop 6' of the web 6 pulls on the limbs 1, 2 of the clamping member so drawing the base 3 of that member towards the portion of the web 6 between it and the edge of the aperture 8 and the links 1 and 2 urge the web 6 therebetween to form a bight over the co-operating element 7 as seen in FIG. 2. At the same time contraction of the loop 6' urges the free ends of the limbs 1, 2 of the clamping member towards one another, as illustrated in FIG. 2, so that portions of such limbs 1 and 2 near the base 3 thereof clamp the portions of the web 6 between said limbs 1 and 2 and the moulding 7. Such clamping of the sides of the bight in web 6 effectively prevents displacement of the web 6, and whilst the web 6 is in tension the force on loop 6' augments deterent to displacement of the tortuous shape of that portion of the web 6 between the apertures 4, (see FIG. 2).

The clamping device also includes, as shown in FIGS. 1 and 2, a quick release element comprising a rectangular metal ring 11 having opposite parallel sides 12 and 13. The side 12 lies within the U-shaped clamping member between the base 3 and web 6 passing through the clamping member so that side 12 can engage the inside face of the base 3 of the clamping member. The side 13 has a rotatable handle 14 thereon.

To release the clamping device from its clamping condition using the quick release element 11 it is only necessary for the handle 14 to be gripped and pulled generally upwardly (as viewed in FIG. 1), the upward force exerted on the ring 11 forces side 12 to engage the underside of base 3, and the applied force lifts the clamping member (as viewed in FIG. 1) relative to the co-operating element 7 to bring the clamping device to a released condition.

In the clamping device shown in FIGS. 3 and 4 the co-operating element comprises a main member of substantially U-shape having limbs 21, 22 with a base portion 23 and a rectangular section bar 24 with stub axle portions 25, 26 at its ends which engage in apertures in the limbs 21, 22 closer to the base 23 than the free ends 21' and 22' of the member. The free ends 21' and 22' of the limbs 21, 22 are oppositely inturned and terminate spaced apart from one another. The clamping member, as in the FIG. 1 and FIG. 2 embodiments, comprises limbs 27, 28 integral with a base 29. Each of the limbs 27, 28 has two parallel slots 30, 31 parallel with the base 29.

The clamping device of FIGS. 3 and 4 is used with two flexible bands 32, 33 of which one end of the band 32 is passed around the base 23 of the main member and then secured to the band proper as by stitches 34, whilst at the other end of this band 32 is secured a ring or other attachment device (not shown). An end of the band 33 is passed through the slots 30 in the limbs 27, 28 of the clamping member, while that member is in position with the bar 24 extending between its limbs 27 and 28, and then attached to the band proper as by stitches 35 so forming a loop at that end of the band. The band 33 is then passed through a ring 36 or other attachment device through which it may freely move and then passes through the slot 31 in limb 28 over the top (as viewed in FIGS. 3 and 4) of the bar 24 and then through the slot 31 in limb 27.

With the rings or other attachment devices (not shown for the band 32 and ring 36 for the band 33) connected to spaced points between which tension is to be applied and mainained, the free end of the band 33 is pulled manually to draw more of that band through the slots 31 with reduction of the effective length of the two bands. As the pull on the free end of the band 33 increases the tension in the band 33, the loop end of the band 33 attached to the free ends of limbs 27 and 28 pulls on the clamping member to move said member relative to the bar 24 and by its closure to move the free ends of the limbs 27, 28 towards one another. The band 33 is thus caused to form a bight between limbs 27 and 28 and thereby the band 33 assumes a tortuous path (see FIG. 4) between the edges of the slots 31 through which it passes and the bar 24 which resists reverse movement thereof. The base ends of the limbs 27, 28 also press portions of the band 33 against the bar 24 further to resist reverse movement of the band 33. The band 33 is thus firmly held in its tensioned length adjusted condition, even though it may be slippery due to being wet or other conditions.

The bands 32 and 33 may now be further tensioned and the clamping device locked in operative condition by rotation of its main member through some 180° relative to the bar 24, with movement of its base 23 to the opposite side of the rotational axis, i.e. into the position shown in FIG. 4, when part of the band 32 is passed between the ends 21', 22' of the limbs of the main member to hold the main member against reverse rotation.

The clamping device also includes a quick release element defined by a triangular metal element 37 having sides 38, 39 and 40. The clamping member straddles the side 38 so that side 38 lies between the flexible band 33 and the base 29 of the clamping member, and a lanyard 41, is secured at one end to the junction of the sides 39 and 40 and has its other end secured to the strap 32 at a location (not shown) above stitching 34.

When the device is in the clamping condition shown in FIG. 4 the device can be released by simply pulling on the lanyard 41, such tensioning of the lanyard 41 serving to lift the element 37 (as viewed on FIGS. 3 and 4) to engage side 38 against the underside of the base 29 thereby to lift the clamping member relative to the bar 24 to reduce, and eventually eliminate, the bight in the strap 33 between limbs 27 and 28. As the depth of the bight in strap 33 reduces, said strap slips through the slots 31, thus easing the tension in strap 33 and rendering easier, the continued release of the clamping member.

Means (not shown) may be provided at the free end of the band 33 to prevent it accidentally slipping out of the slots 31 once assembled to the condition shown in FIG. 3.

In the support arrangement for a floatation device shown in FIG. 5, in this case a support for a life raft, there is provided a frame comprising two side frame members 48 and 49, each made from a single piece of metal tubing, and defining, in continuous connection, a raft support member 50, a front leg 51, a foot runner 52, a rear leg 53, and a back piece 54. The free end of the raft support member 50 may be welded to the rear leg 53, and the member 50 is inclined downwardly towards the front legs 51 when the foot runner 52 is substantially horizontal.

The frame members 48 and 49 are retained in spaced apart parallel relationship by a front foot member 55, which can be clamped to a deck, and a rear foot member 56 which is clamped to the deck and pivotally attached to the lower regions of the rear legs 53 via a pivot pin 57. The back pieces 54 of frames 48 and 49 are directed inwardly towards one another and a horizontal cross member 58 is secured to said pieces 54 and extends from each side of the assembled frames 48, 49. A front member 59 secured, as by welding to the lower ends of the raft support member 50 extends parallel to the cross member 58.

A raft to be supported on the support arrangement may seat directly onto the members 50 or the raft may be supported on rigid or flexible ramp members, illustrated by numerals 60 and 61, which extend between parallel members 58 and 59 and which may be longitudinally adjustable thereon.

The support arrangement further includes a restraint sling 62 which has its two ends **62*a* and 62*b* attached to the cross member 58 outwardly of back pieces 54. The sling 62 passes through a metal ring 63 as will be seen from FIG. 5**.

A plate 64 welded to the front member 59 presents a pivot pin 65 upon which a bell crank lever 66 is pivotally supported, said bell crank lever including a forward arm **66*a* which has a hooked end for engaging and retaining the ring 63 and a rearward arm 66*b***.

The free end of the rearward arm **66*b* is supportable by a clamping device, with a quick release element, of the type shown in FIGS. 1 and 2, the said free end 66*b* is attached to the moulding defining the co-operating element 7 (as viewed in FIG. 1) by a short sling 67 and the clamping device is inverted from the FIG. 1 position to allow the adjustable length means, defined by a strap 68 to extend from the looped end attachment to the clamping member through a free running lug presented by the cross member 58 and back through the slots 4 in the clamping member. The quick release element 11 of the clamping device is captive by a strap 69 which has one end secured to the rear foot member 56, which passes through the quick release device and has its free end detachably secured to the pivot pin 57**.

In operation, a raft is placed on the support members 50, or members 60 and 61, the restraint sling 62 is passed over the top of the raft and down the front thereof so that ring 63 lies adjacent the hooked end of arm **66*a*. The bell crank lever 66 is first rotated clockwise (as viewed in FIG. 5) to elevate the hooked end of arm 66*a* and the ring 63 is slipped onto the hooked end of arm 66*a* for retention thereby. The lever 66 is then rotated anticlockwise (as seen in FIG. 5) and, with the strap 69 released, the strap 68 is tensioned by pulling on the free end thereof, such tensioning elevating the adjacent end 66*b* of lever 66 to tension the restraint sling 62, until eventually the restraint sling 62 is at the desired tension when the clamping member is allowed to clamp the strap 68**.

The strap 69 is then tightened, without placing any undue downward force on the quick release element 11.

With the support arrangement described above, the raft is continuously supported by the tensioned restraining sling 62 and, if in time, the restraint sling 62 should become slack, it only becomes necessary to re-tension the strap 68.

To release the raft it is only necessary to manually deflect the strap 69, by pulling downwardly or simply kicking against the strap 69 intermediate its ends, the tension applied to the strap 69 is transmitted to the quick release device 11 which operates to withdraw the clamping member towards its release conditon and the strap 68 is thereby released.

With strap 68 released the lever 66 can be easily and readilly rotated clockwise (as viewed in FIG. 5) and the ring 63 disconnected from arm **66*a*** to allow the raft to fall freely from the frame.

In an alternative arrangement the sling 67 may engage in a slot in the undersurface of arm **66*b* to facilitate release of arm 66*b*** when the clamping device is released.

I claim:

1. In combination, a support arrangement for a floatation device and a clamping device, said support device comprising a frame for supporting the floatation device, a restraining sling for restraining the floatation device on the frame and a lever pivotally attached to said frame and having one free end detachably engageable with said restraining sling and its other end supportable by the clamping device, said clamping device comprising a co-operating element, attached to that end of said lever remote from said end detachably engageable with said restraining sling, having an aperture therethrough, a U-shaped clamping member, defined by a base with two spaced apart limbs integral with said base, mounted on said co-operating member with the said base located in said aperture and said limbs passing one on each side of the said co-operating member, first apertures in the free ends of said limbs, second apertures in said limbs between said first apertures and said base, a flexible adjustable length member having one end passing through said first apertures in both said limbs and secured to retain said end with said limbs, said flexible adjustable length member extending from said end around a fixed part of said frame and then back to the clamping device to pass through said second apertures in said limbs whereby a section of said flexible adjustable length member lies between said co-operating element and said base, and a quick release element associated with the said clamping member and actuable to displace the said clamping member relative to the co-operating element in the direction to increase the distance between the said base and said co-operating member.

2. The combination set forth in claim 1 and wherein said frame is made from tubular material and comprises support members upon which the floatation device is supported, and a frame part against which the floatation device is restrained by the restraining sling.

3. The combination set forth in claim 1 and wherein said frame includes an underpart supporting the support members above the surface upon which the frame is mounted.

4. The combination set forth in claim 1, and wherein the frame is pivotally attached to a support surface upon which said frame stands and whereby the frame, and any floatation device supported thereon, can be rotated through some 90° about a horizontal axis to facilitate mounting and servicing of the floatation device.

5. The combination set forth in claim 1 and wherein said restraining sling has its ends fixedly secured to spaced apart locations on the upper regions of the said frame and the mid-region of said sling is engageable with said pivotal lever, conveniently through an attaching member.

6. The combination set forth in claim 1 and wherein said lever is a bell crank lever, that end engageable with the restraining sling has a hook shaped end to facilitate engagement with and retention of the sling, and the other free end attaches to said co-operating element via a sling.

7. The combination set forth in claim 1 and wherein the length of the lever arm between its pivotal connection and the co-operating element is between 3.5 and 5.5 times greater than the length of the lever arm between the pivotal connection and the restraint sling engagement.

8. The combination set forth in claim 1 and wherein said co-operating element is attached to the said end of said lever, said flexible adjustable length member, when in tension, urges the said lever to pivot in a direction to maintain said restraining sling in tension, and said quick release element has a flexible actuating member attached thereto and extending away from the clamping device, in the direction opposite to the direction of said flexible adjustable length means from said clamping device, to an anchorage on the said frame.

9. A clamping device comprising a U-shaped member defined by a base and two spaced apart limbs integral with said base, a co-operating element between the limbs of said U-shaped member, co-operating apertures in the said limbs and through which a flexible adjustable length member can pass so as to lie between said co-operating element and said base of said U-shaped member, said apertures being spaced from said base of said U-shaped member whereby, when said U-shaped member is displaced in one direction to define a clamping condition for the device, the distance between the co-operating element and the base of the U-shaped member is reduced and said co-operating element engages the flexible adjustable length member between the limbs of the U-shaped member and forms a bight therein to clamp said flexible adjustable length member and, when the U-shaped member is displaced in the opposite direction from said clamping condition, said base is moved away from said co-operating element to progressively reduce the depth of the bight in said flexible adjustable length member and subsequently loses engagement with the flexible adjustable length member, thus releasing said flexible adjustable length member, and characterized in that the device includes a quick release element associated with the said U-shaped member and adapted, when actuated to positively displace the U-shaped member from said clamping condition to a released conditon and in which said quick release device comprises a closed loop member which passes through the U-shaped member between the said base and the flexible adjustable length material lying between said limbs.

* * * * *